US010024621B2

(12) United States Patent
Hutson

(10) Patent No.: US 10,024,621 B2
(45) Date of Patent: Jul. 17, 2018

(54) ADJUSTABLE SIGHTING AND SHOOTING FIREARM MOUNTING VISE

(71) Applicant: Herman Hutson, Baton Rouge, LA (US)

(72) Inventor: Herman Hutson, Baton Rouge, LA (US)

( * ) Notice: Subject to any disclaimer, the term of this patent is extended or adjusted under 35 U.S.C. 154(b) by 0 days.

(21) Appl. No.: 15/625,880

(22) Filed: Jun. 16, 2017

(65) Prior Publication Data

US 2017/0363382 A1 Dec. 21, 2017

Related U.S. Application Data

(60) Provisional application No. 62/350,808, filed on Jun. 16, 2016.

(51) Int. Cl.
*F41A 27/28* (2006.01)
*F41A 19/08* (2006.01)
*F41A 23/16* (2006.01)

(52) U.S. Cl.
CPC ..... *F41A 27/28* (2013.01); *F41A 19/08* (2013.01); *F41A 23/16* (2013.01)

(58) Field of Classification Search
CPC ..... F41A 27/28; F41A 19/08; F41A 23/16; F41A 23/52; F41A 31/00; F41A 31/02
See application file for complete search history.

(56) References Cited

U.S. PATENT DOCUMENTS 4,012,860 A * 3/1977 Auger ..... F41A 23/16 42/94
4,196,653 A * 4/1980 Jackson ..... F41A 19/08 89/136
5,761,954 A * 6/1998 Dvorak ..... G01L 5/22 73/167
6,237,462 B1 * 5/2001 Hawkes ..... F41A 23/12 89/37.05
7,587,854 B2 * 9/2009 Werner ..... F41A 23/16 42/69.01

(Continued)

OTHER PUBLICATIONS

"A Simple Adaption Which Allows a Quadriplegic to Fire a Gun", 2016, http://www.handihelp.net/579/index.html.*

*Primary Examiner* — Stephen Johnson
*Assistant Examiner* — Joshua T Semick

(57) ABSTRACT

An adjustable sighting and shooting firearm mounting vise receives a firearm to assist new shooters or handicap shooters with sighting and discharging the firearm. The firearm mounting vise includes a base plate, a positional-adjustment track, a forend support, a stock vise, a slide stop, a trigger actuator, a trigger switch, a controller housing, a wireless receiver, and a microcontroller. The base plate supports the positional-adjustment track. The positional-adjustment track allows the forend support, the stock vise, and the trigger actuator to translate along the base plate to accommodate a plurality of firearms to be secured by the firearm mounting vise. The slide stop secures the positional-adjustment track to the base plate. The controller housing protects electrical components including the microcontroller and the wireless receiver. The microcontroller receives control signals through the wireless receiver or directly from the trigger switch to activate the trigger actuator and discharging the firearm.

20 Claims, 8 Drawing Sheets

(56) References Cited

U.S. PATENT DOCUMENTS

| | | | | |
|---|---|---|---|---|
| 7,886,474 | B2 * | 2/2011 | Werner | F41A 23/16 42/94 |
| 8,234,968 | B2 * | 8/2012 | Hodge | F41A 27/06 89/37.17 |
| 8,474,170 | B2 * | 7/2013 | Durham | F41A 23/16 42/94 |
| 8,516,943 | B2 * | 8/2013 | Rogers | B24C 5/02 89/41.02 |
| 8,544,202 | B2 * | 10/2013 | Bastian, Jr. | F41A 23/02 42/94 |
| 9,062,927 | B1 * | 6/2015 | Tepaske | F41A 25/18 |

* cited by examiner

ADJUSTABLE SIGHTING AND SHOOTING FIREARM MOUNTING VISE

The current application claims a priority to the U.S. Provisional Patent application Ser. No. 62/350,808 filed on Jun. 16, 2016.

FIELD OF THE INVENTION

The present invention relates generally to an apparatus for a remotely controlled sighting-in and shooting device. More specifically, the present invention is a remotely controlled sighting and shooting device used to greatly reduce the human error, as well as, providing recreational shooting opportunities for physically handicapped gun enthusiasts.

BACKGROUND OF THE INVENTION

Firearms are typically used for protection, competition, and recreational use. Proper training to use firearms is important to reduce possible injury or accidental death from unintentional discharge of the firearm. Traditionally, a person being trained is handed a firearm after receiving explanations of how the firearm works and etiquette for safely handling the firearm. New users, particularly younger users, may be unfamiliar with handling the kickback from some firearms recoiling. Uncompensated or improperly compensated recoil may cause direct injury to the shooter or bystander due to a ricocheting bullet.

The present invention is an adjustable sighting and shooting firearm mounting vise. The present invention greatly reduces human error associated with manually sighting-in a weapon, to facilitate the sighting-in process, to provide recreational training and shooting opportunities for young shooters, and to provide recreational shooting opportunities for physically handicapped gun enthusiasts. The present invention spares the shooter from recoil by securing the firearm to the present invention. Further, the present invention is able to be activated remotely to spare the shooter from the loud noises associated with the discharge of the fire arm.

DETAIL DESCRIPTIONS OF THE INVENTION

All illustrations of the drawings are for the purpose of describing selected versions of the present invention and are not intended to limit the scope of the present invention.

The present invention is an adjustable sighting and shooting firearm mounting vise. The present invention assists young and handicap shooters with learning and discharging firearms safely. The present invention secures a firearm for the shooter to remotely sight and discharge the firearm, sparing the shooter from recoil and the loud noises associated with discharging a firearm. The present invention assists in removing human error with sighting and discharging the firearm.

Figure 1:
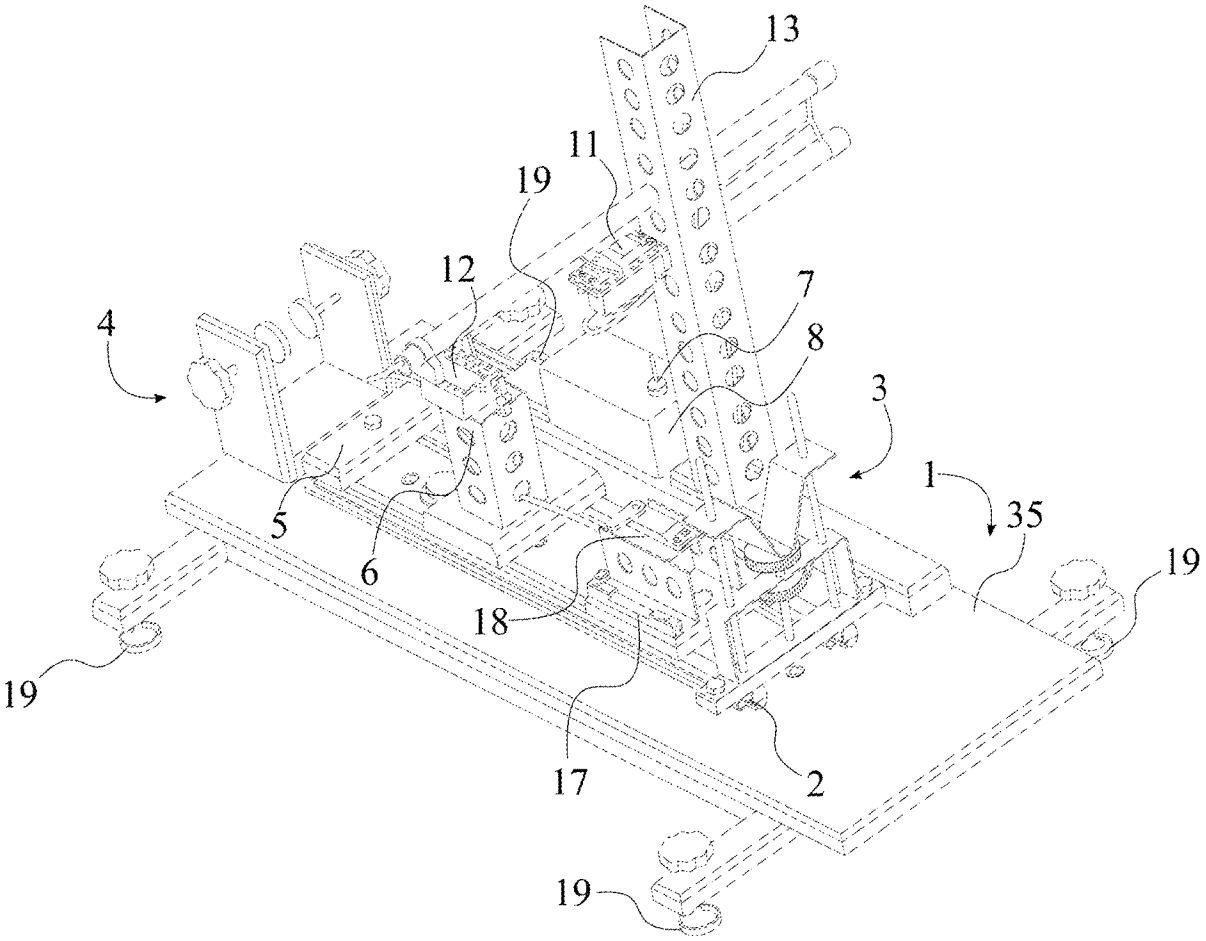
FIG. 1 is a perspective view of the present invention.
Figure 2:
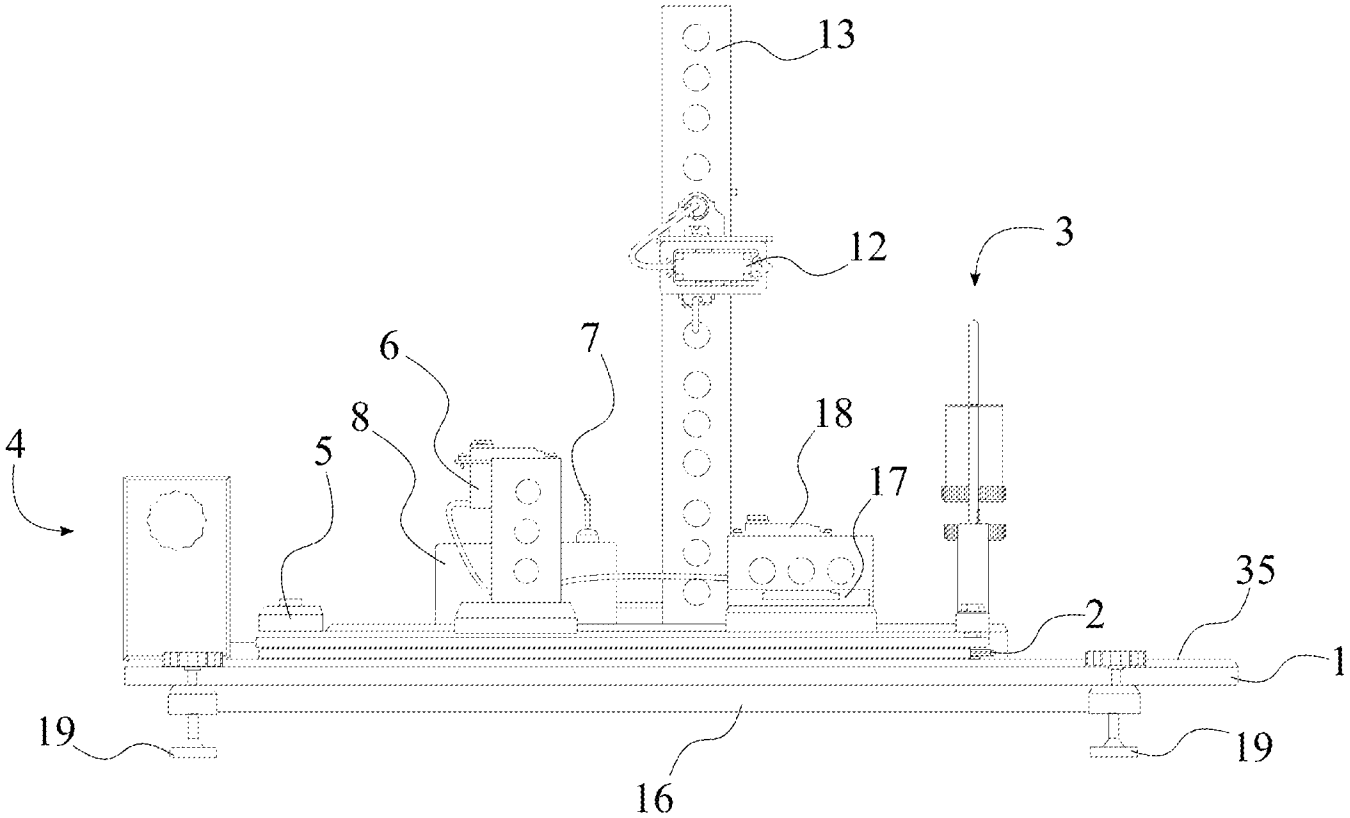
FIG. 2 is a left view of the present invention.
Figure 3:
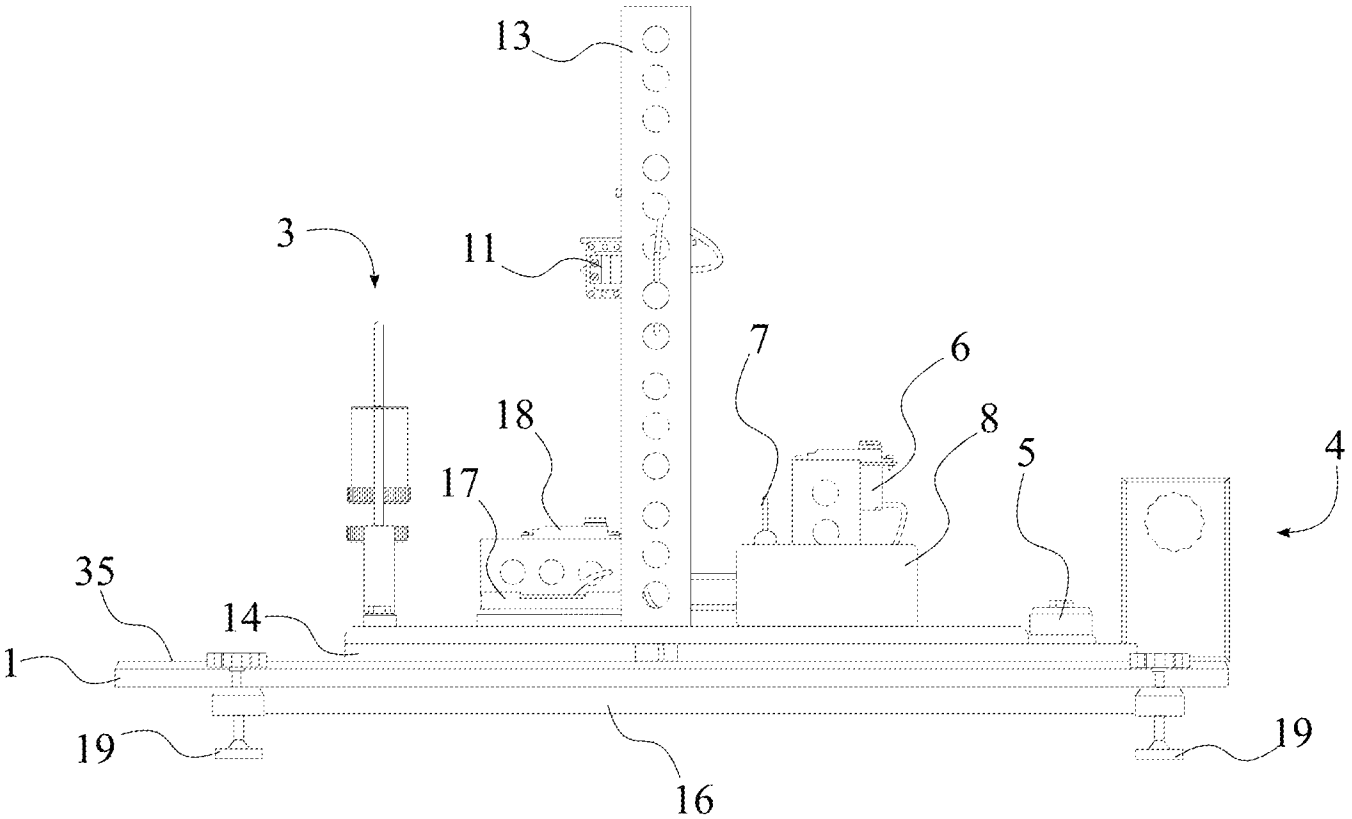
FIG. 3 is a right view of the present invention.
Figure 6:
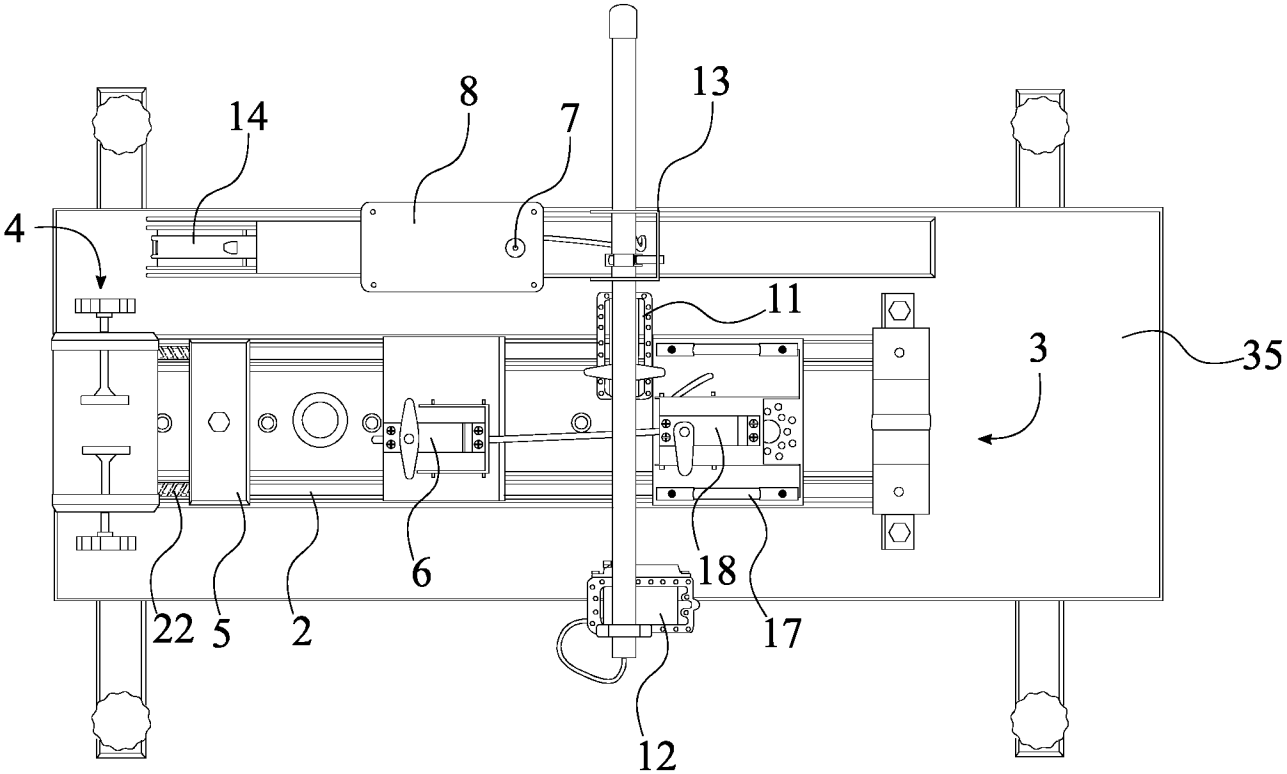
FIG. 6 is a top view of the present invention.
Figure 7:
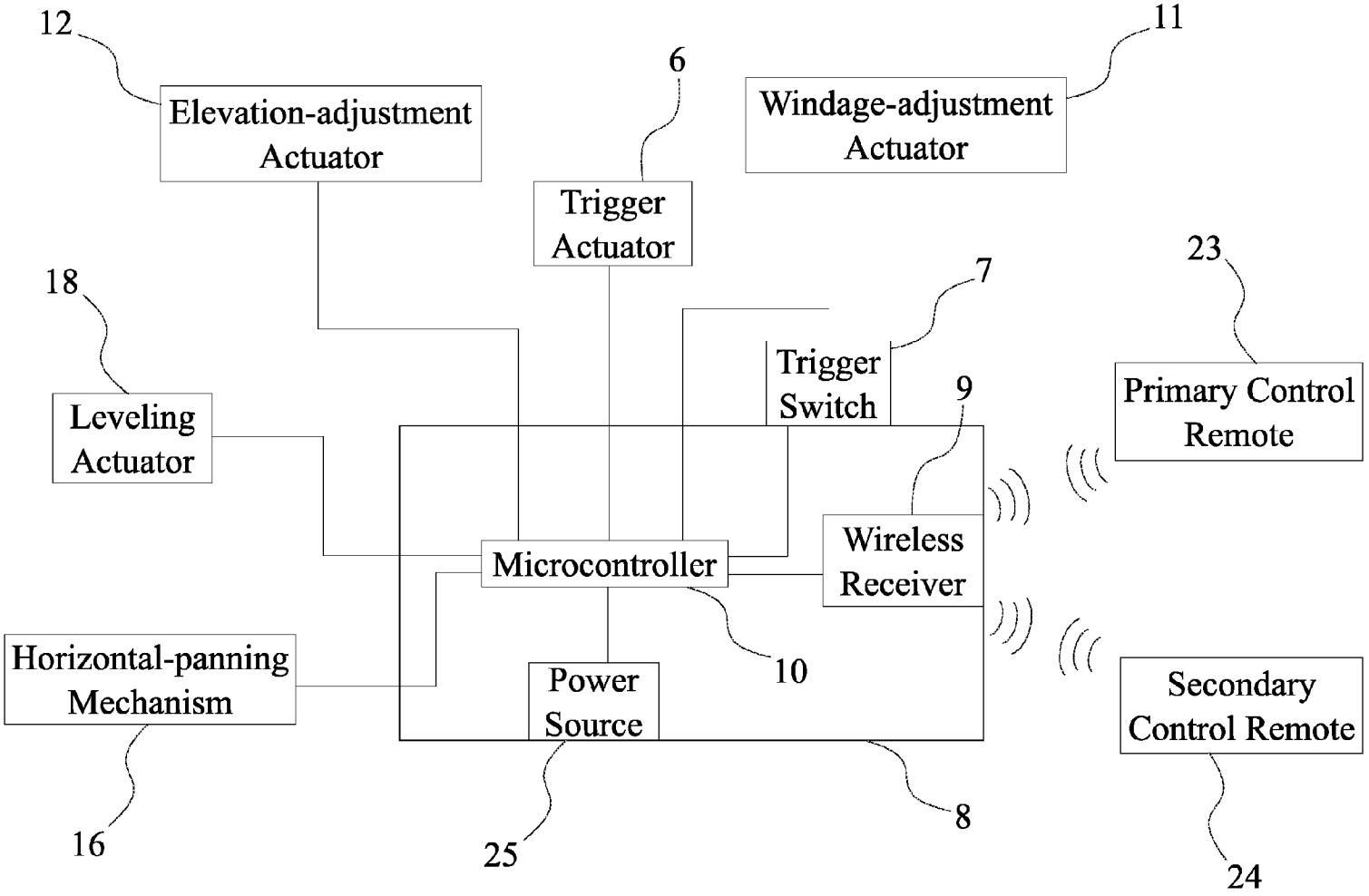
FIG. 7 is schematic diagram showing the connections between electrical components of the present invention.

The present invention comprises a base plate 1, a positional-adjustment track 2, a forend support 3, a stock vise 4, a slide stop 5, a trigger actuator 6, a trigger switch 7, and a controller housing 8, in accordance to FIG. 1, as well as, a wireless receiver 9 and a microcontroller 10, shown in FIG. 7. The base plate 1 supports the positional-adjustment track 2 and the controller housing 8. The positional-adjustment track 2 allows for the adjustment of the forend support 3, the slide stop 5, and the trigger actuator 6 along the base plate 1 in order to accommodate a plurality of firearms. Detailed in FIG. 1 to FIG. 6, the positional-adjustment track 2 is integrated along a top face 35 of the base plate 1, such that the user is able to easily access the forend support 3, the slide stop 5, and the trigger actuator 6 to accommodate the shooter's firearm. The forend support 3 supports the forend or barrel of a rifle, carbine, or other long gun. The slide stop 5 secures the positional-adjustment track 2 to the base plate 1. In accordance to the preferred embodiment, the slide stop 5 is positioned between the stock vise 4 and the trigger actuator 6 to effectively secure the positional-adjustment track 2 to the base plate 1. The forend support 3, the slide stop 5, and the trigger actuator 6 are slideably engaged with the positional-adjustment track 2 such that the shooter is able to position the forend support 3, the slide stop 5, and the trigger actuator 6 to accommodate a plurality of firearms. The stock vise 4 is secured to the stock of the firearm to compensate for recoil of the firearm as traditionally by a shooter's shoulder. The stock vise 4 is adjacently connected to the base plate 1. In accordance to the preferred embodiment of the present invention, the stock vise 4 is terminally positioned along the positional-adjustment track 2 to effectively receive the stock for long guns or grips for short guns and allow the trigger actuator 6 to interface with the firearm. The trigger actuator 6 engages the trigger of the firearm to discharge the firearm when selectively activated by the shooter. The trigger actuator 6 is positioned between the stock vise 4 and the forend support 3 such that the trigger actuator 6 can effectively engage the trigger of the secured firearm.

The controller housing 8 supports a plurality of electrical components including the wireless receiver 9 and the microcontroller 10, shown in FIG. 7. The controller housing 8 is mounted onto the top face 35. The trigger switch 7 initiates a control signal to actuate the trigger actuator 6 to discharge the firearm. The trigger switch 7 is adjacently connected to the controller housing 8 to be accessible to the shooter. The wireless receiver 9 and the microcontroller 10 are internally mounted to the controller housing 8, in order to protect the wireless receiver 9 and the microcontroller 10 from dust, debris, or other environmental hazards. The trigger switch 7, the wireless receiver 9, and the trigger actuator 6 are electronically connected to the microcontroller 10 to allow the microcontroller 10 to process and distribute control signals between the trigger switch 7, the wireless receiver 9, and the trigger actuator 6.

In accordance to the preferred embodiment of the present invention, the present invention comprises an elevation-adjustment actuator 11, detailed in FIG. 1 and FIG. 3 to FIG. 7. The elevation-adjustment actuator 11 interfaces with a firearm scope to manipulate an elevation-adjustment knob of the scope to adjust the vertical sighting of the firearm. The elevation-adjustment actuator 11 is mounted to the top face 35. The elevation-adjustment actuator 11 is offset from the top face 35. Therefore, the elevation-adjustment actuator 11 is suspended above the top face 35 during implementation of the present invention, such that the elevation-adjustment actuator 11 is able to engage the elevation-adjustment knob for a scope of a firearm secured by the present invention. The elevation-adjustment actuator 11 is electronically connected to the microcontroller 10, such that the elevation-adjustment actuator 11 receives control signals from the microprocessor to adjust the elevation-adjustment knob.

Further in accordance to the preferred embodiment of the present invention, the present invention comprises a windage-adjustment actuator 12, shown in FIG. 1, FIG. 2, and FIG. 4 to FIG. 8. Similar to the elevation-adjustment actuator 11, the windage-adjustment actuator 12 interfaces with a firearm scope to manipulate a windage-adjustment knob of the scope to adjust the horizontal sighting of the firearm. The windage-adjustment actuator 12 is similarly mounted to the top face 35, and the windage-adjustment actuator 12 is offset from the top face 35, such that the windage-adjustment actuator 12 is suspended above the top face 35 during implementation of the present invention. Therefore, the windage-adjustment actuator 12 is able to be positioned to engage the windage-adjustment knob for the scope of a firearm secured by the present invention. The windage-adjustment actuator 12 is electronically connected to the microcontroller 10, such that the windage-adjustment actuator 12 receives control signals from the microcontroller 10 to adjust the windage-adjustment knob to sight the scope.

For a more specific embodiment of the present invention, the present invention comprises a sighting support 13 and a sighting-support track 14, in accordance to FIG. 3 to FIG. 6. The sighting support 13 supports the weight of the elevation-adjustment actuator 11 and the windage-adjustment actuator 12. The sighting-support track 14 secures the sighting support 13 to the top face 35. The sighting-support track 14 is integrated along the top face 35. The sighting support 13 is slideably connected to the sighting-support track 14, such that the sighting support 13 is able to translate along the top face 35. The elevation-adjustment actuator 11 and the windage-adjustment actuator 12 are mounted to the top face 35 through the sighting support 13. Therefore, the translation of the sighting support 13 along the top face 35 allows the elevation-adjustment actuator 11 and the windage-adjustment actuator 12 to be positioned adjacent to the scope for a plurality of scoped firearms. The sighting-support track 14 is preferred to be offset from the positional-adjustment track 2 to prevent the sighting support 13, the elevation-adjustment actuator 11, and the windage-adjustment actuator 12 from interfering with the translation of the forend support 3, the trigger actuator 6, and the slide stop 5 along the positional-adjustment track 2.

Figure 8:
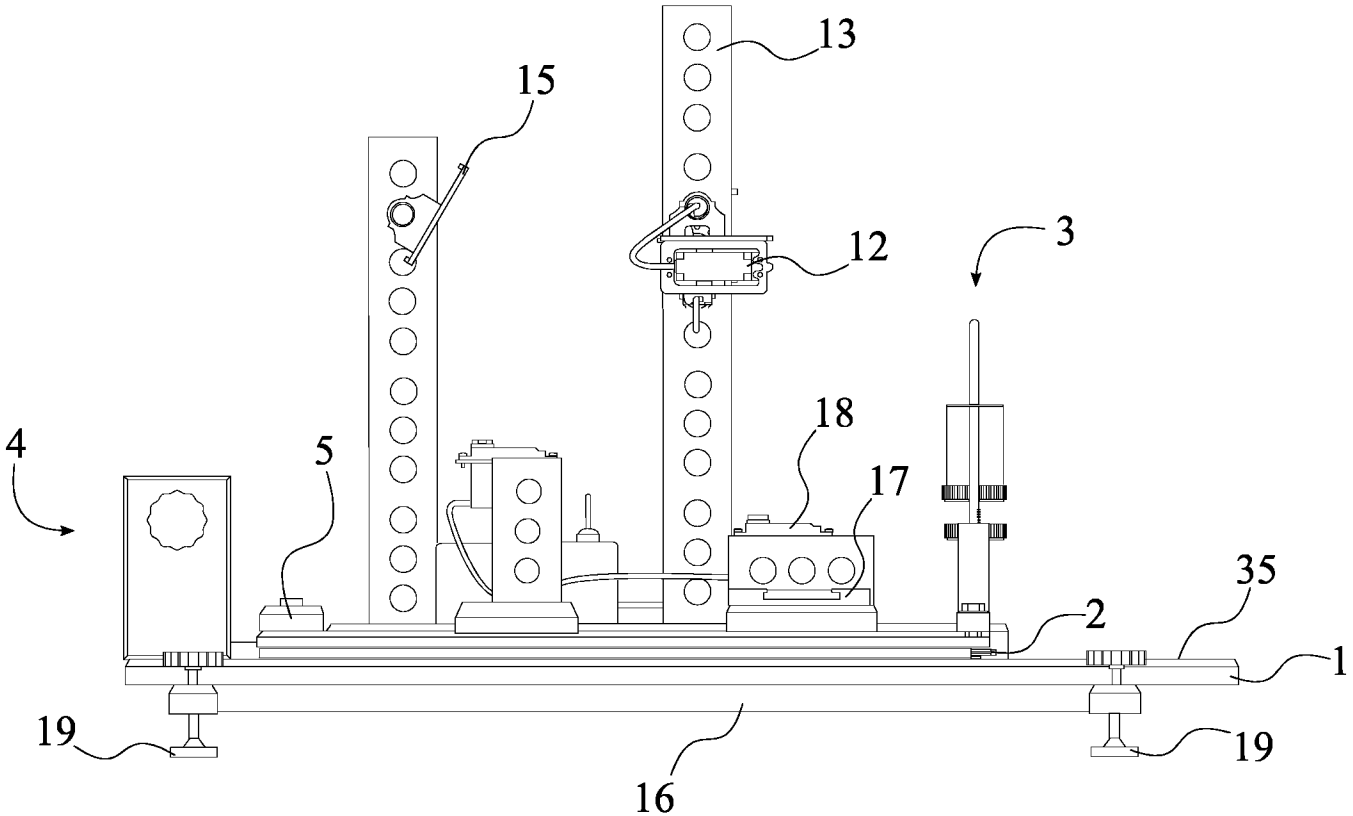
FIG. 8 is a left view of an alternate embodiment of the present invention, wherein the present invention comprises a scope-display mount.

For some embodiments of the present invention, the present invention comprises a scope-display mount 15, shown in FIG. 8. The scope-display mount 15 supports a display device, such as a smartphone or camera, that indirectly displays the view through the scope. Thus, the view through the scope is able to be enlarged. Additionally, this indirect view through the scope allows the shooter to be at a distance from the scope as the firearm is discharged, therefore preventing the shooter from being injured due to recoil of the firearm as the firearm is discharged. The scope-display mount 15 is mounted to the top face 35, similar to the elevation-adjustment actuator 11 and the windage-adjustment actuator 12. The scope-display mount 15 is offset from the top face 35, and the scope-display mount 15 is positioned between the stock vise 4 and the forend support 3. This configuration allows the scope-display mount 15 to be positioned adjacent and oriented towards to a lens of the scope to display the view through the scope down range of the firearm.

In some embodiments of the present invention, the present invention comprises a horizontal-panning mechanism 16, shown in FIG. 2 to FIG. 5. The horizontal-panning mechanism 16 allows the aim of the firearm to be adjusted horizontally. The horizontal-panning mechanism 16 is rotatably connected to the base plate 1. The horizontal-panning mechanism 16 is oppositely positioned to the top face 35 about the base plate 1. This configuration allows the base plate 1 to be rotated by the horizontal-panning mechanism 16 to give the shooter greater degrees of freedom for motion for aiming the firearm. The horizontal-panning mechanism 16 is electronically connected to the microcontroller 10, such that the horizontal-panning mechanism 16 receives control signals from the microcontroller 10 to rotate the base plate 1.

Further in accordance to preferred embodiment of the present invention, the present invention comprises a level indicator 17 and a leveling actuator 18, shown in FIG. 1 to FIG. 3, FIG. 6 and FIG. 8. The level indicator 17 displays the pitch of the base plate 1 with respect to the surface the present invention is resting to allow the shooter to adjust for the pitch when sighting the firearm. The level indicator 17 and the leveling actuator 18 is slideably mounted to the positional-adjustment track 2. The leveling actuator 18 raises or lowers the base plate 1 with respect to the position of the leveling actuator 18 along the positional-adjustment track 2 and the surface that the present invention is resting during implementation. The leveling actuator 18 is electronically connected to the microcontroller 10 in order to receive control signals to move the base plate 1 up or down. More specifically, the leveling actuator 18 is adjacently positioned to the level indicator 17 to show the pitch of the base plate 1 at the leveling actuator 18. The leveling actuator 18 is preferred to be positioned between the trigger actuator 6 and the forend support 3, such that the leveling actuator 18 is generally centered along the base plate 1.

For some embodiments of the present invention, the present invention comprises a plurality of adjustable leveling feet 19, detailed in FIG. 1 to FIG. 5 and FIG. 8. The plurality of adjustable leveling feet 19 allows the shooter to manually adjust the height of the base plate 1 about the perimeter of the base plate 1. The plurality of adjustable leveling feet 19 is mounted to the base plate 1. The plurality of adjustable leveling feet 19 is oppositely oriented with the top face 35 about the base plate 1, such that the plurality of adjustable leveling feet 19 interfaces with surface that the present invention rests during implementation. The plurality of adjustable leveling feet 19 is evenly distributed about the base plate 1 in order to distribute the weight of the base plate 1 on the surface.

Figure 5:
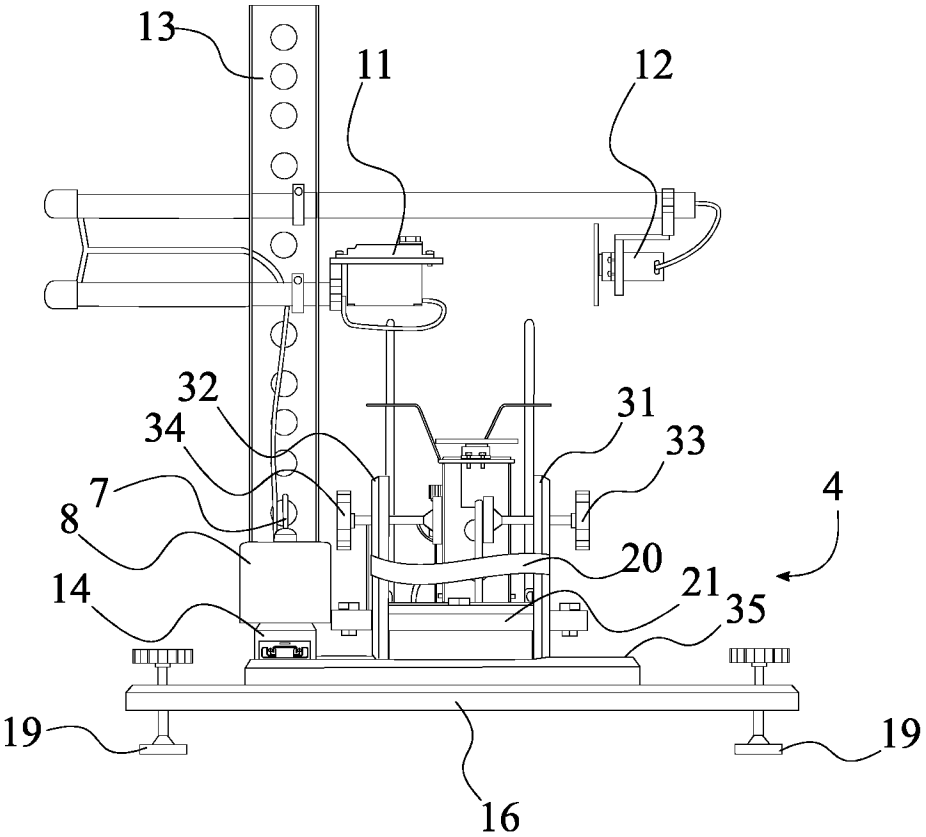
FIG. 5 is a rear view of the present invention, wherein the present invention comprises a recoil-restraint strap.

In accordance to the preferred embodiment of the stock vise 4, the stock vise 4 comprises a first vise support 31, a second vise support 32, a first stock-vise fastener 33, and a second stock-vise fastener 34, shown in FIG. 5. The first vise support 31 and the second vise support 32 sustain the weight for a stock of the firearm as the first stock-vise fastener 33 and the second stock-vise fastener 34 apply pressure to the stock from opposing sides of the stock. The first vise support 31 and the second vise support 32 are adjacently connected to the base plate 1. The first vise support 31 and the second vise support 32 are offset from each other, such that the stock is received between the first vise support 31 and the second vise support 32. The first vise support 31 and the second vise support 32 are oriented normal to the base plate 1. The first stock-vise fastener 33 traverses through the first vise support 31. Similarly, the second stock-vise fastener 34 traverses through the second vise support 32. This configuration allows the first stock-vise fastener 33 and the second stock-vise fastener 34 to engage the stock to apply pressure from either side of the stock, therefore securing the stock between the first vise support 31 and the second vise support 32. More specifically, the first stock-vise fastener 33 threadedly engages the first vise support 31, such that the first stock-vise fastener 33 is adjustable through the first vise support 31 to accommodate a plurality of firearm stocks. Similarly, the second stock-vise fastener 34 threadedly engages the second vise support 32, such that the second stock-vise fastener 34 is adjustable through the second vise support 32 to accommodate a plurality of firearm stocks.

In some embodiments of the present invention, the present invention comprises a recoil-restraint strap 20, shown in FIG. 5. The recoil-restraint strap 20 restrains the firearm at the stock during recoil of the firearm as its discharged. The recoil-restraint strap 20 is laterally connected between the first vise support 31 and the second vise support 32 in order to distribute the force from the recoil to the first vise support 31 and the second vise support 32 through the recoil-restraint strap 20. In some other more specific embodiments of the present invention, the present invention comprises a stock rest 21. The stock rest 21 provides additional support for the weight of the stock as the shooter is securing the stock between the first stock-vise fastener 33 and the second stock-vise fastener 34. The stock rest 21 is connected between the first vise support 31 and the second vise support 32. The stock rest 21 is offset from the base plate 1, such that the firearm is displaced from the base plate 1 to prevent damage to the base plate 1 or firearm as the firearm is discharged.

Figure 4:
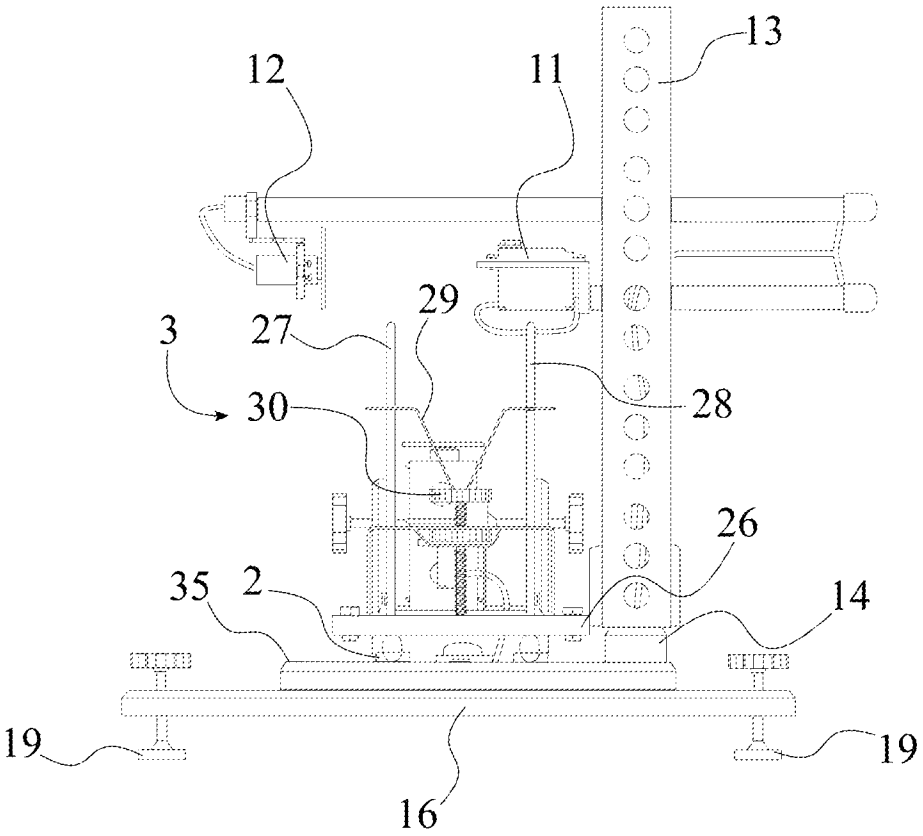
FIG. 4 is a front view of the present invention.

In accordance to the preferred embodiment of the forend support 3, the forend support 3 comprises a forend support base 26, a first height-adjustment support 27, a second height-adjustment support 28, a forend receiving channel 29, and a height-adjustment mechanism 30, shown in FIG. 4. The forend support base 26 supports the first height-adjustment support 27, the second height-adjustment support 28, the forend receiving channel 29, and the height-adjustment mechanism 30 on the positional-adjustment track 2. The forend support base 26 is slideably connected to the positional-adjustment track 2, in order to allow the forend support 3 to accommodate firearms with a plurality of forends or a plurality of barrels for long guns. The first height-adjustment support 27 and the second height-adjustment support 28 are adjacently connected to the forend support base 26. The first height-adjustment support 27 and the second height-adjustment support 28 are oriented normal to the base plate 1, and the first height-adjustment support 27 and the second height-adjustment support 28 are offset from each other in order to support the forend receiving channel 29. The forend receiving channel 29 is connected between the first height-adjustment support 27 and the second height-adjustment support 28. The height-adjustment mechanism 30 is connected between the forend receiving channel 29 and the forend support base 26, such that the forend receiving channel 29 is adjustable along the first height-adjustment support 27 and the second height-adjustment support 28. Adjusting the position of the forend receiving channel 29 subsequently adjusts the angle of the barrel of the firearm vertically from the base plate 1.

In some embodiments of the present invention, the present invention further comprises at least one recoil shock 22, in accordance to FIG. 6. The at least one recoil shock 22 dampens the recoil of discharging the firearm. The at least one recoil shock 22 is connected to the stock vise 4. The at least one recoil shock 22 is positioned within the positional-adjustment track 2, such that the at least one recoil shock 22 is parallel to the barrel of the firearm to compensate for the recoil from discharging the firearm.

In accordance to the preferred embodiment of the present invention, the present invention comprises a primary control remote 23, in accordance to FIG. 7. The primary control remote 23 is a remote device, such as a smartphone, a long-range radio frequency (RF) device, a short-range RF device, or any similar remote control device, that allows the shooter to adjust the elevation-adjustment actuator 11, the windage-adjustment actuator 12, the horizontal-panning mechanism 16, and the leveling actuator 18, as well as to remotely initiate the trigger actuator 6 to discharge the firearm. The primary control remote 23 is communicatively coupled with the wireless receiver 9 to receive a control signal to adjust the elevation-adjustment actuator 11, the windage-adjustment actuator 12, the horizontal-panning mechanism 16, and the leveling actuator 18 or initiate the trigger actuator 6. The primary control remote 23 is preferred to be used by the shooter.

More specifically, the present invention further comprises a secondary control remote 24, shown in FIG. 7. The secondary control remote 24 similarly functions like the primary control remote 23, although the control signals from the secondary control remote 24 supersede the control signals from the primary control remote 23. The secondary control remote 24 is communicatively coupled with the wireless receiver 9, similar to the primary control remote 23. The secondary control remote 24 is preferred to be used by an instructor. The instructor is able to use the secondary control remote 24 to prevent the microcontroller 10 from processing control signals from the primary control remote 23, such as the initiation of the trigger actuator 6, until the instructor is confident the shooter followed the proper steps to prepare to discharge the firearm.

Further in accordance to FIG. 7, the present invention comprises a power source 25 to provide electrical energy to the elevation-adjustment actuator 11, the windage-adjustment actuator 12, the horizontal-panning mechanism 16, the leveling actuator 18, the trigger actuator 6, the microcontroller 10, and the wireless receiver 9. The power source 25 is preferred to be a battery. The power source 25 is internally mounted to the controller housing 8. The power source 25 is electrically connected to the microcontroller 10 such that electrical power is distributed to the elevation-adjustment actuator 11, the windage-adjustment actuator 12, the horizontal-panning mechanism 16, the leveling actuator 18, the trigger actuator 6, and the wireless receiver 9.

Although the invention has been explained in relation to its preferred embodiment, it is to be understood that many other possible modifications and variations can be made without departing from the spirit and scope of the invention as hereinafter claimed.

What is claimed is:

1. An adjustable sighting and shooting firearm mounting vise comprising:

a base plate;

a positional-adjustment track;

a forend support;

a stock vise;

a slide stop;

a trigger actuator;

a trigger switch;

a controller housing;

a wireless receiver;

a microcontroller;

the positional-adjustment track being integrated along a top face of the base plate;

the forend support, the slide stop, and the trigger actuator slideably engaging the positional-adjustment track;

the stock vise being adjacently connected to the base plate;

the trigger actuator being positioned between the stock vise and the forend support;

the controller housing being mounted to the top face;

the trigger switch being adjacently connected to the controller housing;

the wireless receiver and the microcontroller being internally mounted to the controller housing; and the trigger switch, the wireless receiver, and the trigger actuator being electronically connected to the microcontroller.

2. The adjustable sighting and shooting firearm mounting vise, as claimed in claim 1, comprising:

the slide stop being positioned between the stock vise and the trigger actuator.

3. The adjustable sighting and shooting firearm mounting vise, as claimed in claim 1, comprising:

the stock vise being terminally positioned along the positional-adjustment track.

4. The adjustable sighting and shooting firearm mounting vise, as claimed in claim 1, comprising:

an elevation-adjustment actuator;

the elevation-adjustment actuator being mounted to the top face;

the elevation-adjustment actuator being offset from the top face; and the elevation-adjustment actuator being electronically connected to the microcontroller.

5. The adjustable sighting and shooting firearm mounting vise, as claimed in claim 1, comprising:

a windage-adjustment actuator;

the windage-adjustment actuator being mounted to the top face;

the windage-adjustment actuator being offset from the top face; and the windage-adjustment actuator being electronically connected to the microcontroller.

6. The adjustable sighting and shooting firearm mounting vise, as claimed in claim 1, comprising:

an elevation-adjustment actuator;

a windage-adjustment actuator;

a sighting support;

a sighting-support track;

the sighting-support track being integrated along the top face;

the sighting support being slideably connected to the sighting-support track;

the sighting-support track being offset from the positional-adjustment track; and the elevation-adjustment actuator and the windage-adjustment actuator being mounted to the top face through the sighting support.

7. The adjustable sighting and shooting firearm mounting vise, as claimed in claim 1, comprising:

a scope-display mount;

the scope-display mount being mounted to the top face;

the scope-display mount being offset from the top face; and the scope-display mount being positioned between the stock vise and the forend support.

8. The adjustable sighting and shooting firearm mounting vise, as claimed in claim 1, comprising:

a horizontal-panning mechanism;

the horizontal-panning mechanism being rotatably connected to the base plate;

the horizontal-panning mechanism being oppositely positioned to the top face about the base plate; and the horizontal-panning mechanism being electronically connected to the microcontroller.

9. The adjustable sighting and shooting firearm mounting vise, as claimed in claim 1, comprising:

a level indicator;

a leveling actuator;

the level indicator and the leveling actuator being slideably mounted to the positional-adjustment track; and the leveling actuator being electronically connected to the microcontroller.

10. The adjustable sighting and shooting firearm mounting vise, as claimed in claim 9, comprising:

the leveling actuator being adjacently positioned to the level indicator; and the leveling actuator being positioned between the trigger actuator and the forend support.

11. The adjustable sighting and shooting firearm mounting vise, as claimed in claim 1, comprising:

a plurality of adjustable leveling feet;

the plurality of adjustable leveling feet being mounted to the base plate;

the plurality of adjustable leveling feet being oppositely oriented with the top face about the base plate; and the plurality of adjustable leveling feet being evenly and perimetrically distributed about the base plate.

12. The adjustable sighting and shooting firearm mounting vise, as claimed in claim 1, comprising:

the stock vise comprising a first vise support, a second vise support, a first stock-vise fastener, and a second stock-vise fastener;

the first vise support and the second vise support being adjacently connected to the base plate;

the first vise support and the second vise support being oriented normal to the base plate;

the first stock-vise fastener traversing through the first vise support; and the second stock-vise fastener traversing through the second vise support.

13. The adjustable sighting and shooting firearm mounting vise, as claimed in claim 12, comprising:

the first stock-vise fastener being threadedly engaged with the first vise support; and the second stock-vise fastener being threadedly engaged with the second vise support.

14. The adjustable sighting and shooting firearm mounting vise, as claimed in claim 12, comprising:

a recoil-restraint strap; and the recoil-restraint strap being laterally connected between the first vise support and the second vise support.

15. The adjustable sighting and shooting firearm mounting vise, as claimed in claim 12, comprising:

a stock rest;

the stock rest being connected between the first vise support and the second vise support; and the stock rest being offset from the base plate.

16. The adjustable sighting and shooting firearm mounting vise, as claimed in claim 1, comprising:

the forend support comprising a forend support base, a first height-adjustment support, a second height-adjustment support, a forend receiving channel, and a height-adjustment mechanism;

the forend support base being slideably connected to the positional-adjustment track;

the first height-adjustment support and the second height-adjustment support being adjacently connected to the forend support base;

the first height-adjustment support and the second height-adjustment support being oriented normal to the base plate;

the first height-adjustment support and the second height-adjustment support being offset from each other;

the forend receiving channel being connected between the first height-adjustment support and the second height-adjustment support;

the height-adjustment mechanism being connected between the forend receiving channel and the forend support base.

17. The adjustable sighting and shooting firearm mounting vise, as claimed in claim 1, comprising:

at least one recoil shock;

the at least one recoil shock being connected to the stock vise; and the at least one recoil shock being positioned within the positional-adjustment track.

18. The adjustable sighting and shooting firearm mounting vise, as claimed in claim 1, comprising:

a primary control remote; and the primary control remote being communicatively coupled with the wireless receiver.

19. The adjustable sighting and shooting firearm mounting vise, as claimed in claim 1, comprising:

a secondary control remote; and the secondary control remote being communicatively coupled with the wireless receiver.

20. The adjustable sighting and shooting firearm mounting vise, as claimed in claim 1, comprising:

a power source;

the power source being internally mounted to the controller housing; and the power source being electrically connected to the microcontroller.

* * * * *